US011697057B2

(12) United States Patent
Surdy et al.

(10) Patent No.: US 11,697,057 B2
(45) Date of Patent: Jul. 11, 2023

(54) BINDING ALLOWING LIFTING OF THE FRONT AS WELL AS THE HEEL OF THE USERS FOOT

(71) Applicant: BACKWARDS SPÓŁKA Z OGRANICZONĄ ODPOWIEDZIALNOŚCIĄ, Bielsko-Biała (PL)

(72) Inventors: Wojciech Surdy, Bielsko-Biała (PL); Wojciech Wieczorek, Bielsko-Biała (PL); Paweł Pasternak, Bielsko-Biała (PL)

(73) Assignee: BACKWARDS SPÓŁKA Z OGRANICZONĄ ODPOWIEDZIALNOŚCIĄ, Bielsko-Biala (PL)

( * ) Notice: Subject to any disclaimer, the term of this patent is extended or adjusted under 35 U.S.C. 154(b) by 288 days.

(21) Appl. No.: 16/625,764

(22) PCT Filed: Jun. 19, 2018

(86) PCT No.: PCT/IB2018/054519
§ 371 (c)(1),
(2) Date: Dec. 23, 2019

(87) PCT Pub. No.: WO2018/235002
PCT Pub. Date: Dec. 27, 2018

(65) Prior Publication Data

US 2020/0139220 A1 May 7, 2020

(30) Foreign Application Priority Data

Jun. 22, 2017 (PL) ..... 421988

(51) Int. Cl.
*A63C 10/26* (2012.01)
*A63C 9/08* (2012.01)
*A63C 13/00* (2006.01)

(52) U.S. Cl.
CPC ..... *A63C 10/26* (2013.01); *A63C 9/0805* (2013.01); *A63C 9/0807* (2013.01); *A63C 13/006* (2013.01)

(58) Field of Classification Search
CPC ..... A63C 10/26; A63C 9/0805; A63C 9/0807; A63C 13/006
See application file for complete search history.

(56) References Cited

U.S. PATENT DOCUMENTS 6,409,204 B1 * 6/2002 Ayliffe ..... A63C 9/20 36/117.3
7,296,805 B2 * 11/2007 Lindemann ..... A63C 10/14 280/14.22

(Continued)

FOREIGN PATENT DOCUMENTS

DE 102009036244 A1 2/2011
EP 1669113 A1 * 6/2006 ..... A63C 9/02

(Continued)

*Primary Examiner* — James A Shriver, II
*Assistant Examiner* — Michael T. Walsh
(74) *Attorney, Agent, or Firm* — Andrzej Malarz, Esq.

(57) ABSTRACT

A binding for skis and/or splitboard and/or roller skis and/or snowshoes permitting free lifting of the heel, which permits to lift the front part of the foot. The object of the present solution is also an adapter for standard bindings, a method of binding shoes for skis and/or splitboard and/or roller skis and/or snowshoes, and also a shoe for riding skis and/or splitboard and/or roller skis intended for use in bindings permitting free lifting of the heel.

3 Claims, 7 Drawing Sheets

(56) References Cited

U.S. PATENT DOCUMENTS

| | | | | |
|---|---|---|---|---|
| 8,801,025 | B2 * | 8/2014 | Mars | A43B 5/16 280/607 |
| 2008/0116663 | A1 * | 5/2008 | Gyr | A63C 9/20 280/611 |
| 2013/0009387 | A1 * | 1/2013 | Maruelli | A63C 9/02 280/611 |
| 2016/0199722 | A1 * | 7/2016 | Ritter | A63C 9/006 280/617 |
| 2016/0317900 | A1 * | 11/2016 | Bombard | A63C 9/006 |

FOREIGN PATENT DOCUMENTS

| | | | | | |
|---|---|---|---|---|---|
| EP | 1961 463 | A1 | | 8/2008 | |
| EP | 1961463 | A1 | * | 8/2008 | A63C 13/003 |
| EP | 3096845 | A1 | | 11/2016 | |
| FR | 2 779 659 | A1 | | 12/1999 | |
| FR | 2779659 | A1 | * | 12/1999 | A63C 13/006 |
| FR | 2833179 | A1 | * | 6/2003 | A63C 1/28 |
| FR | 2912928 | A1 | * | 8/2008 | A63C 13/003 |
| IT | UB20 156 856 | A1 | | 6/2017 | |
| WO | WO-2004035153 | A2 | * | 4/2004 | A43B 5/04 |
| WO | WO-2011114319 | A2 | * | 9/2011 | A63C 9/02 |
| WO | 2014083406 | A1 | | 6/2014 | |
| WO | WO-2014083406 | A1 | * | 6/2014 | A63C 9/02 |
| WO | 20160000993 | A1 | | 1/2016 | |
| WO | 2017074941 | A1 | | 5/2017 | |
| WO | WO-2017074941 | A1 | * | 5/2017 | A63C 13/006 |
| WO | WO-2018235002 | A1 | * | 12/2018 | A63C 9/02 |

* cited by examiner

BINDING ALLOWING LIFTING OF THE FRONT AS WELL AS THE HEEL OF THE USERS FOOT

TECHNICAL FIELD

The object of the present invention is an improved binding for skis and/or splitboard and/or roller skis and/or snowshoes permitting free lifting of the heel, and also an adapter for a binding for skis and/or splitboard and/or roller skis and/or snowshoes, and a method of binding shoes for skis and/or splitboard and/or roller skis and/or snowshoes, and also a shoe for skis and/or splitboard and/or roller skis.

BACKGROUND ART

Patent application US2016199722 discloses a binding for splitboard, which permits free lifting of the heel.

Patent application EP3096845 discloses bindings for telemark, skitouring and/or cross country skis permitting free lifting of the heel and automatic locking of the shoe in the binding.

The bindings sold under mark DYNAFIT are also popular in the market, these bindings require use of stiff, especially designed shoes, as the said bindings do not possess a frame, but two elements, the first of which keeps the toes, and the second—the heel. In the version used for skitour skis the heel of the shoe may be disengaged, and after it's disengaged the heel may be freely lift upwards. Such a binding was for instance disclosed in patent application DE102009036244.

Patent application WO2016000993 discloses a binding for roller skis, which permits free lifting of the heel.

So far running or walking on the skis or other similar equipment required use of different technique than technique used naturally by a human while walking or running. It has been found unexpectedly, that by using relatively simple technical means, it is possible to revolutionize the methods of movement on the skis, splitboards, roller skis or snowshoes.

DISCLOSURE OF THE INVENTION

A binding for skis and/or splitboard and/or roller skis and/or snowshoes permitting free lifting of the heel, according to the invention, is characterized by that it permits to lift the front part of the foot. Therefore the binding modifies the way of movement on the skis, splitboard, roller ski or snowshoe, because it enables lifting of the toes, so it enables the closest imitation of natural walk or run of a human, when a human taking a step puts at first the heel with the toes lifted upwards, then through midfoot he moves the weight of the body to the toes. The solutions used so far do not provide possibility to lift the front part of the foot.

The binding comprises a plate fixed to a ski/board/roller ski/snowshoe in its back and/or middle part and/or any other point between those two parts in a way permitting to lift the front part of the plate, where to the plate a clamp for mounting a shoe is fixed, said clamp permitting to lift the heel.

The clamp keeps the shoe in a way that makes possible lifting of the heel of the shoe. The term "plate" includes also a frame for mounting ski shoes. The plate may be made of a stiff or resilient material, as a composite, or a resilient metal etc., which is susceptible to vertical deformation, but very stable in vertical axis preventing twisting the shoe in relation to the ski/splitboard/roller ski/snowshoe. The back part of the resilient plate may be fixed by stiff joint to the ski/splitboard/roller ski/snowshoe such as rivets or screws preventing the shoe to be twisted horizontally in relation to the ski/splitboard/roller ski/snowshoe. When the plate is made of stiff material, it must be fixed to the ski/splitboard/roller ski/snowshoe with use of movable joint such as a hinge. The front part of the plate is lifted in limited scope. On one hand this limit results from physiological construction of the foot, and on the other hand from the construction of the binding.

An elastic and/or resilient element is located between the plate and the ski/board/roller ski/snowshoe. Preferably the element is mounted under the midfoot. However it is possible to choose another place of its mounting.

The elastic and/or resilient element is made of a polymer composite and/or of gum and/or of rubber or of their mixtures or of metal.

The resilient element is a spring connected with the plate and the ski/board/roller ski/snowshoe.

The elastic element is an elastic plate fixed between the plate and the ski/board/roller ski/snowshoe. The elastic plate is mounted in the front and in the back to the ski/board/roller ski/snowshoe in such a way that it is bended in arch shape directed upwards. In the back part the elastic plate may be connected with the ski by an articulated joint. When the toes are lowered the plate straightens, and after they are lifted, the plate goes back to the previous shape.

The binding comprises a clamp for immobilizing the heel. In this version of the invention it is possible to use the skis, splitboard or roller skis for safe sliding downhill. Thanks to immobilization of the heel it is possible to better control the skis, splitboard or the roller ski. In case of snowshoes immobilization of the heel may be preferable in some of the terrain conditions. At the same time, in order to achieve full control of the means of movement such as skis, splitboard, roller skis or snowshoes, it is necessary to immobilize the front part of the foot. Therefore the binding comprises additionally a clamp for immobilizing the plate, which enables to fix temporary the plate to the surface of the ski/board/roller ski/snowshoe.

The binding comprises a stiff plate fixed to a ski/board/roller ski/snowshoe in its front part, to the said stiff plate at its top side an elastic plate is fixed in a way permitting to lift the front part of this elastic plate.

The stiff plate in its front part is mounted on a hinge to the ski/board/roller ski/snowshoe in a way, that allows to lift the back part of this plate.

The elastic plate and the stiff plate are connected by a frame by hinge bonding. This frame is used for mounting of the shoe and constitutes a scaffold connecting both plates and enabling movement of the toes and the heel up and down. The binding may additionally comprise clamps to immobilize the stiff plate and the elastic plate to enable safe sliding downhill.

An adapter for a binding for skis and/or splitboard and/or roller skis and/or snowshoes permitting lifting of the heel, according to the invention, is characterized by that it permits to lift the front part of the foot.

The adapter comprises a plate fixed to a ski/board/roller ski/snowshoe in its back and/or middle part and/or any other point between those two parts in a way permitting to lift the front part of the plate, where a binding for cross-country skis and/or splitboard and/or roller skis and/or snowshoes is fixed to the plate.

An elastic and/or resilient element is located between the plate (2) and the ski/board/roller ski/snowshoe.

The elastic and/or resilient element is made of a polymer composite and/or of gum and/or of rubber or of their mixtures or of metal.

The resilient element is a spring connected with the plate and the ski/board/roller ski/snowshoe.

The elastic element is an elastic plate fixed between the plate and the ski/board/roller ski/snowshoe. The adapter comprises a clamp for immobilizing the heel.

The adapter comprises a clamp for immobilizing the plate.

The adapter enables transformation of the traditional binding to a binding according to the invention. The adapter may be used both with the bindings having frame and to the binding of DYNAFIT type, where there is no frame, and the shoe is mounted in clamps fixed directly to the ski. In this case the binding is not fixed directly to the ski, but to the plate of the adapter. Similarly the adapter enables fixing the bindings to splitboards, roller skis and snowshoes.

A method of binding shoes for skis and/or splitboard and/or roller skis and/or snowshoes, according to the invention, is characterized by that the shoes are mounted in such a way to permit lifting by turns the heel and the front part of the foot.

The shoe is mounted to the plate fixed to a ski/board/roller ski/snowshoe in its back and/or middle part and/or any other point between those two parts in a way permitting to lift the front part of the plate, where the shoe is mounted in a way permitting to lift the heel.

An elastic and/or resilient element is located between the plate and the ski/splitboard/roller ski/snowshoe. The elastic and/or resilient element is made of a polymer composite and/or of gum and/or of rubber or of their mixtures or of metal.

The resilient element is a spring connected with the plate and the ski/board/roller ski/snowshoe.

The elastic element is an elastic plate fixed between the plate and the ski/board/roller ski/snowshoe. A shoe for riding skis and/or splitboard and/or roller skis intended for use in bindings permitting free lifting of the heel, according to the invention, is characterized by that the sole of the shoe comprises two layers connected with each other in the area of the heel, where the bottom layer of the sole is stiff, and the upper layer of the sole is elastic and permits to lift the toes. The shoe according to the invention may be mounted in known ski tour, splitboard or cross country ski bindings. Two-layer shoe sole permits imitation of natural walk or run of a human.

A clamp used in bindings and the adapter according to the invention for mounting the front part of the shoe are a known and widely used solution, which is characterized by that the front part of the shoe in the area of the toes is fixed by hinge bonding to the ski constituting a stable rotation axis around the toes, and the back part of the foot may freely move in vertical plane, around stable front axis. In case of skis or splitboards used both for climbing and running, as well as for sliding (touring skis, freestyle skis, splitboard etc.) additionally a clamp for locking the heel is used, which permits to immobilize the shoe during sliding.

The essence of the present invention is giving the foot mounted to the skis by means of ski shoe additional degree of freedom enabling it to lift the front part of the foot and its movement in vertical plane around temporary rotation axis placed in the area of the heel, where the energy of this movement is transferred to the ski through the resilient element, which partly cumulates it. In short the invention gives additional degree of freedom and the range of movement of ski touring/splitboard binding (to the each type of bindings enabling walking), enabling tilting it in the direction to the back of the ski/splitboard/roller ski/snowshoe etc.

So far known solutions have limitations during movement e.g. on splitboard/touring skis consisting in forced shortening of the step because of the construction of bindings not permitting to tilt the leg to the back of the ski. In the solutions present on the market, during making a step forward the calf rests on a boot shaft preventing extension of the step, and additionally lack of possibility to raise the front of the binding above the plane of fixing to the ski results in shortening of the step.

The invention permits to tilt the leg in the direction of the back of the ski, what permits to extend the step significantly. A possibility was created to increase the range of movement of the binding (indirectly the point is to create additional rotation axis of the binding or to increase the range of rotation is case of one axis). The bending shall be resilient in order to lift the front of the ski above the surface of the snow. The invention permits also to block all rotations separately in case of their lack in basic binding (rotation around the front and around the back of the foot).

There is also a possibility to fix the plate of the binding or the plate of adapter of the binding in such a way, that the plate is connected by a non-articulated joint with an additional soft plate fixed to the ski/splitboard/roller ski/snowshoe in its front part. Both plates are connected with each other in its back part. The plate of the binding bends resiliently under the applied force (N) (equivalent to the tilt of the binding to the back).

The invention may be used for all types of skis, which are used for walking, running or climbing, for snowshoes, or for splitboard.

BRIEF DESCRIPTION OF THE SEVERAL VIEWS OF THE DRAWINGS

The object of the present invention is illustrated in the examples in drawings.

Example 1

Figure 1:
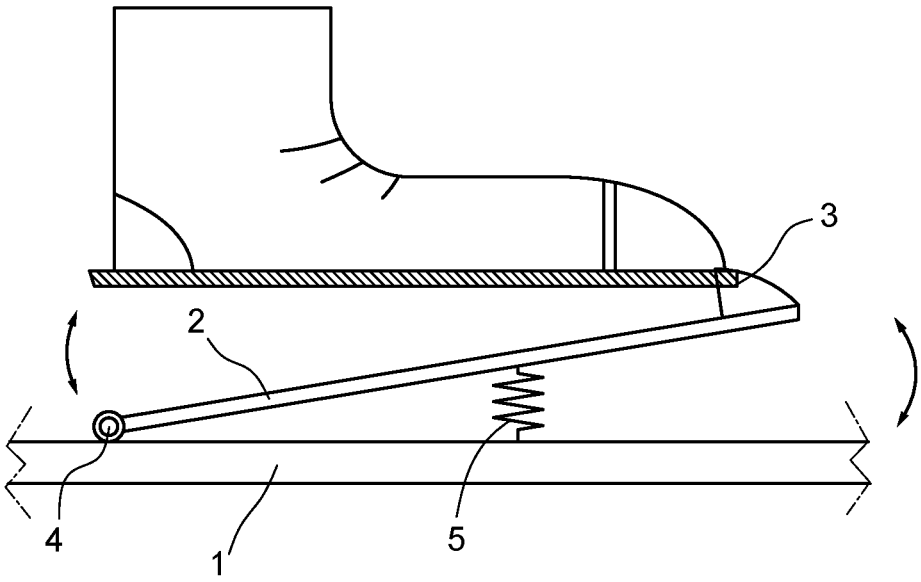
FIGS. 1 to 4 illustrate different variants of the binding.

To a ski 1 a plate 2 is mounted. (FIG. 1). The front of the plate 2 may be lifted upwards. To the plate 2 a shoe clamp 3 is mounted. The shoe clamp 3 permits free lifting and movement of the shoe heel. The plate 2 is connected with the ski 1 by hinge bonding 4. Between the plate 2 and the ski 1 there is a spring 5 mounted under the midfoot of the shoe.

Example 2

Figure 2:
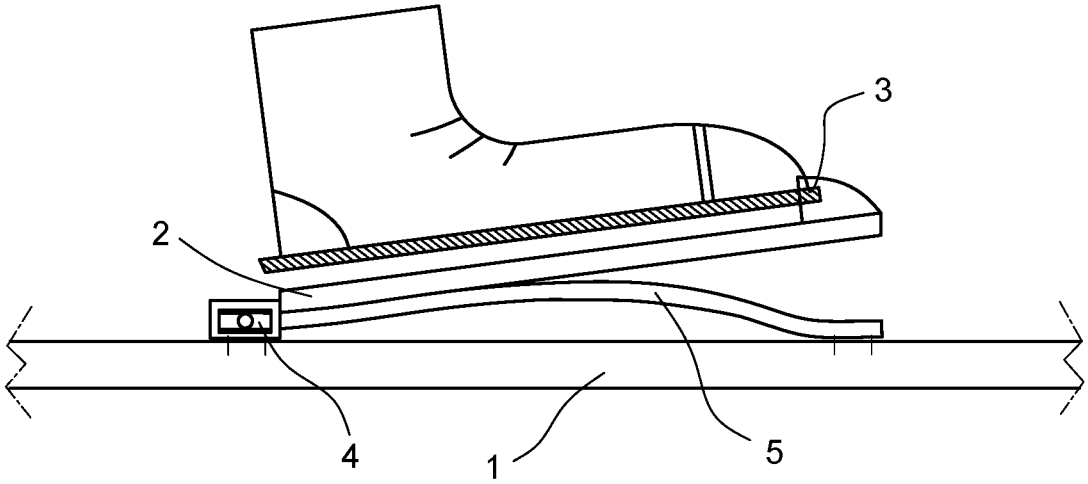

To a ski 1 a plate 2 is mounted (FIG. 2). The plate 2 is elastic. To the plate 2 a shoe clamp 3 is mounted. The shoe clamp 3 permits free lifting and movement of the shoe heel. The plate 2 is connected with the ski 1 by stiff bonding 4. Between the plate 2 and the ski 1 there is an elastic plate 5 connected with the ski by an articulated joint in its back part and by stiff bonding in its front part. The elastic plate 5 is bent upwards to create an arching. The plate pressed from the top straightens, and then comes back to the previous shape—when there is no pressure.

Example 3

Figure 3:
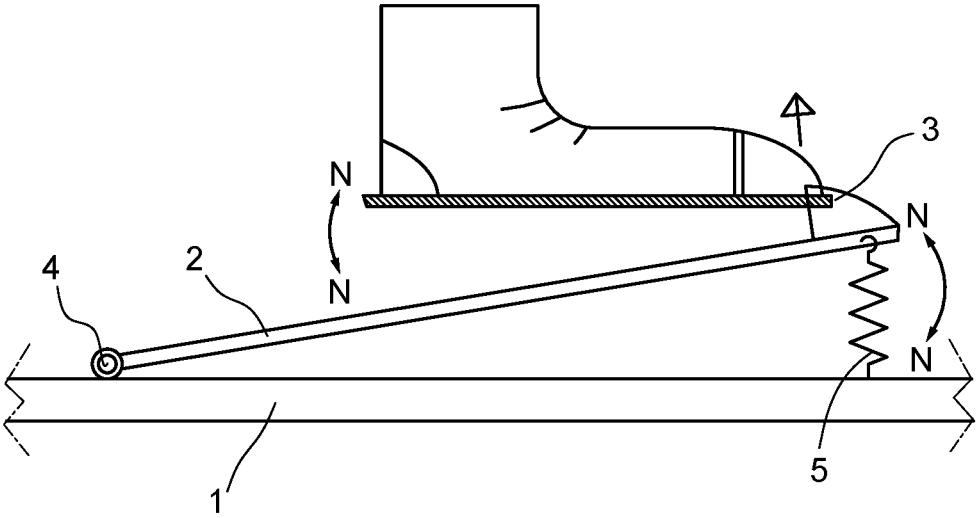

To a ski 1 a plate 2 is mounted (FIG. 3). The front of the plate 2 may be lifted upwards. To the plate 2 a shoe clamp 3 is mounted. The shoe clamp 3 permits free lifting and movement of the shoe heel. The plate 2 is connected with the ski 1 by hinge bonding 4. Between the plate 2 and the ski 1 there is a spring 5. The spring 5 is mounted to the front part of the plate.

Example 4

Figure 4:
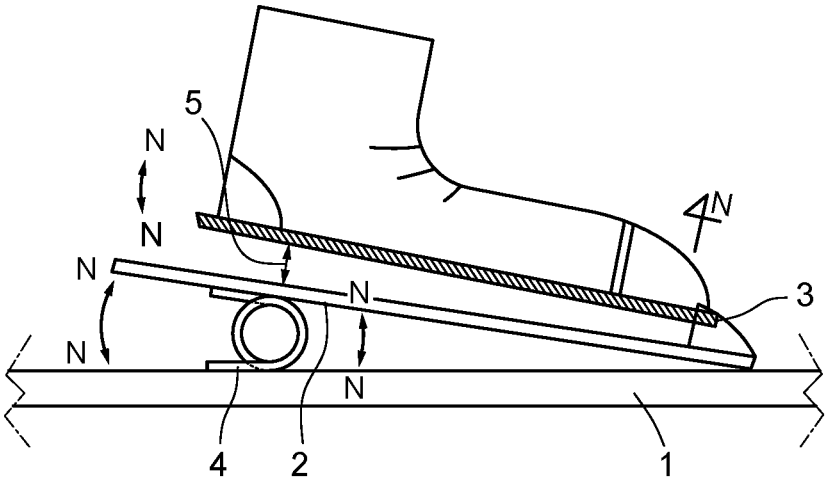

To a ski 1 a plate 2 is mounted 2 (FIG. 4). The front of the plate 2 may be lifted upwards. To the plate 2 a shoe clamp 3 is mounted. The shoe clamp 3 permits free lifting and movement of the shoe heel. The plate 2 is connected with the ski 1 by spring bonding 4. The mounting is placed between the back and the middle part of the plate 2.

Example 5

Figure 5:
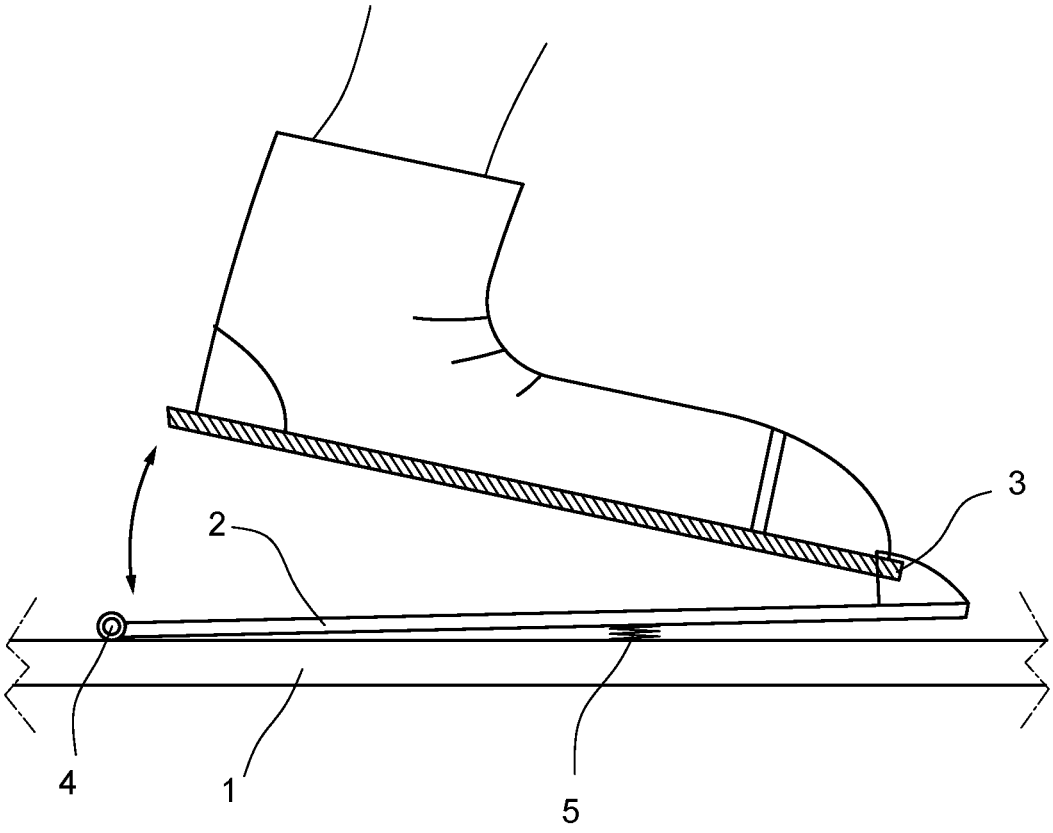
FIGS. 5 and 6 illustrate the principle of action of the binding.
Figure 6:
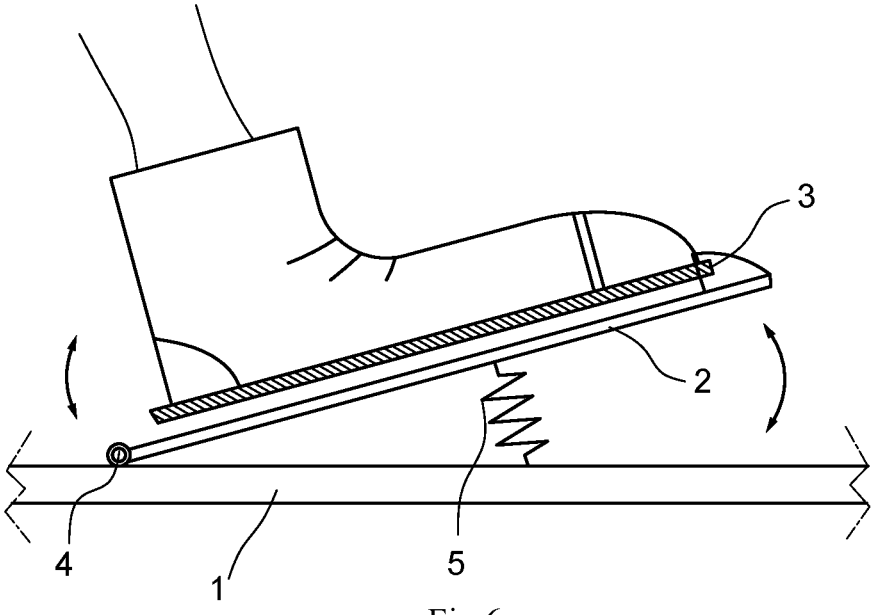

A ski shoe is mounted in the binding 3 (FIG. 5). The skier taking the step lifts the heel and presses the toes to the ski. Then the skier lowers the heel and lifts the toes (FIG. 6). The front of the ski shoe lifts together with the plate 2 upwards, and the heel rests on the plate 2 and presses its back part to the ski 1. Thanks to that the skier is able to move on the skis in a way maximally close to physiological walking.

Example 6

Figure 7:
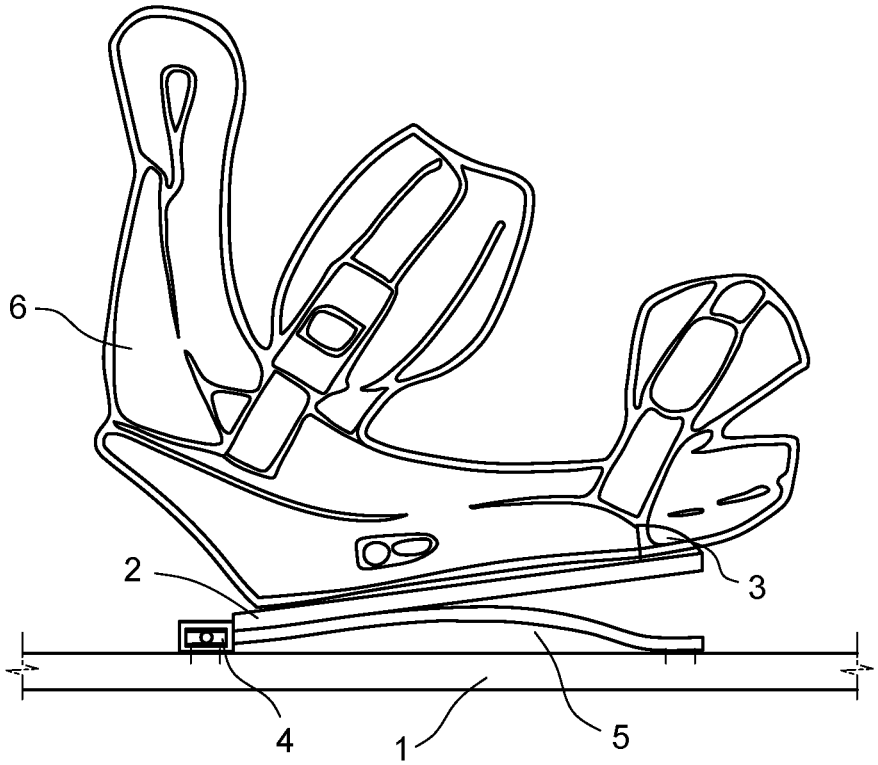
FIGS. 7 to 9 illustrate adapters for mounting the bindings.

To a ski 1 a plate 2 is mounted 2 (FIG. 7). The plate 2 is elastic. The plate 2 is connected with the ski 1 by stiff bonding 4. Between the plate 2 and the ski 1 there is an elastic plate 5. The elastic plate 5 is connected with the ski by an articulated joint in its back part and by stiff bonding in its front part. The elastic plate 5 is bent upwards to create an arching. The plate pressed from the top straightens, and then comes back to the previous shape—when there is no pressure. To the plate 2 a standard ski binding 6 is fixed, in which the shoe toes clamp 3 permits lifting of the shoe heel. The binding 6 has a shoe heel clamp permitting to immobilize the heel during the slide.

Example 7

Figure 8:
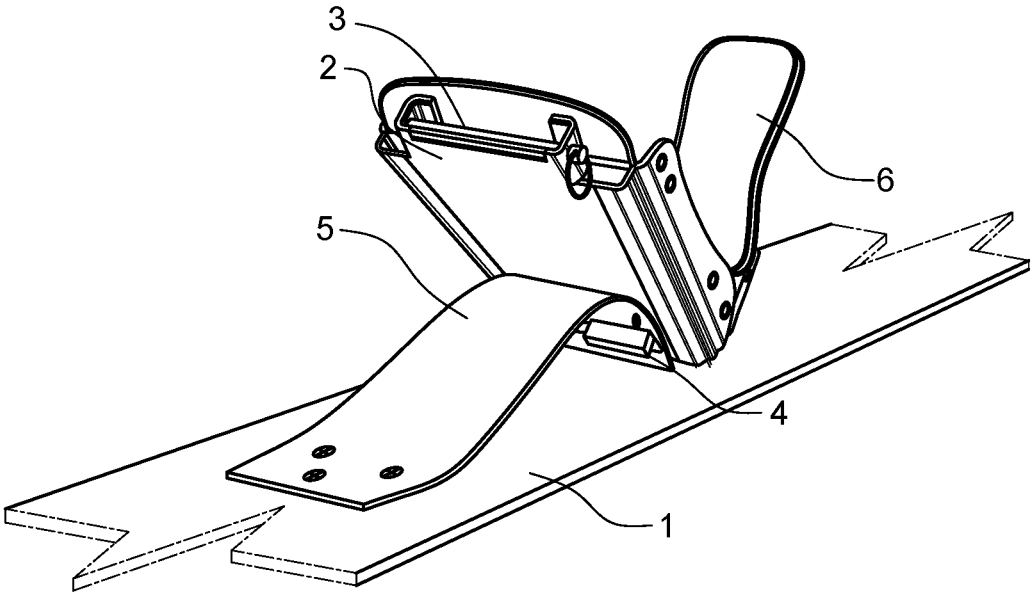

Toa ski 1 a plate 2 is mounted 2 (FIG. 8). The plate 2 is elastic. To the plate 2 a shoe clamp 3 is mounted. The plate 2 is connected with the ski 1 by stiff bonding 4. Between the plate 2 and the ski 1 there is an elastic plate 5. The elastic plate 5 is connected with the ski by an articulated joint in its back part and by stiff bonding in its front part. The elastic plate 5 is bent upwards to create an arching. The plate pressed from the top straightens, and then comes back to the previous shape—when there is no pressure. To the plate 2 a standard ski binding 6 is fixed, in which the shoe toes clamp 3 permits lifting of the shoe heel. The binding 6 has a shoe heel clamp permitting to immobilize the heel during the slide.

Example 8

Figure 9:
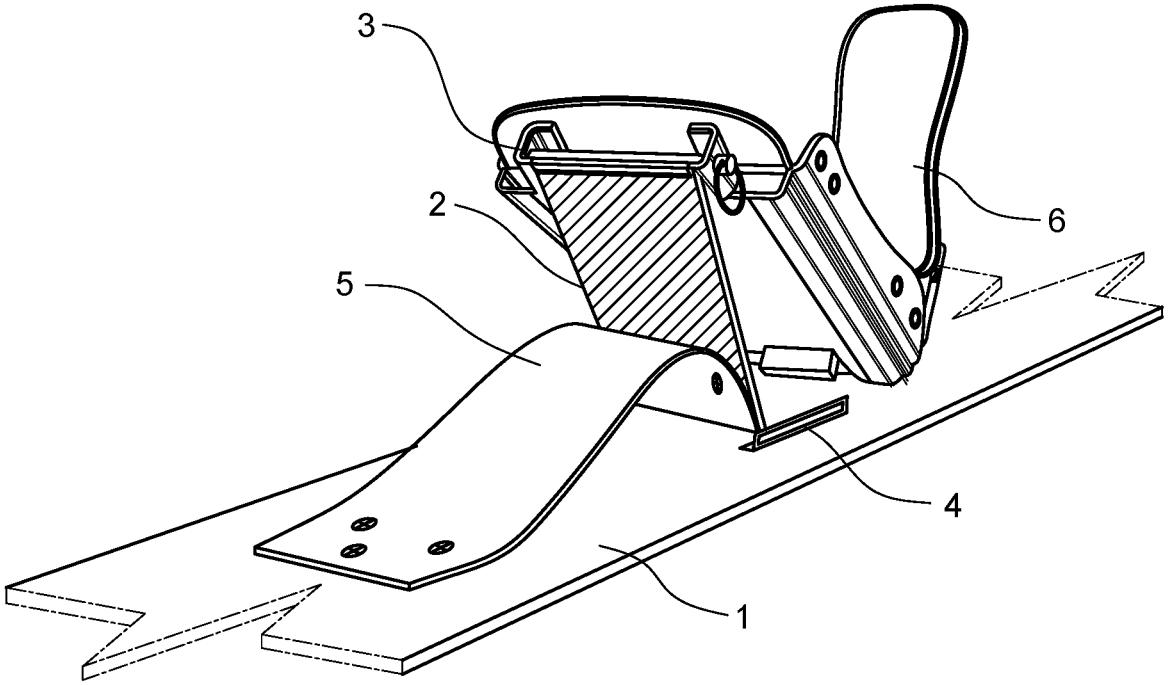
Figure 10:
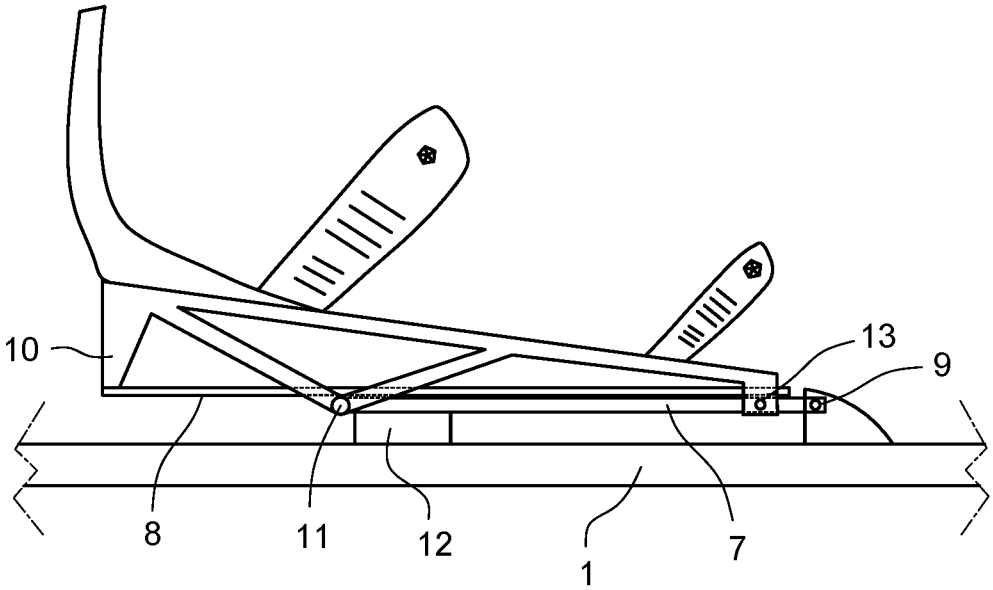
FIGS. 10 and 11 illustrate the binding having frame.
Figure 11:
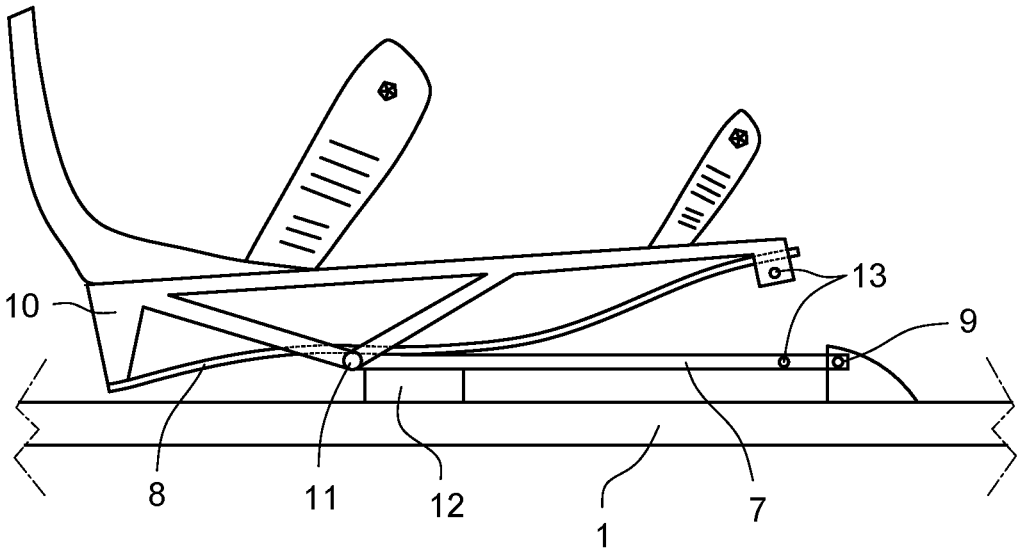
Figure 12:
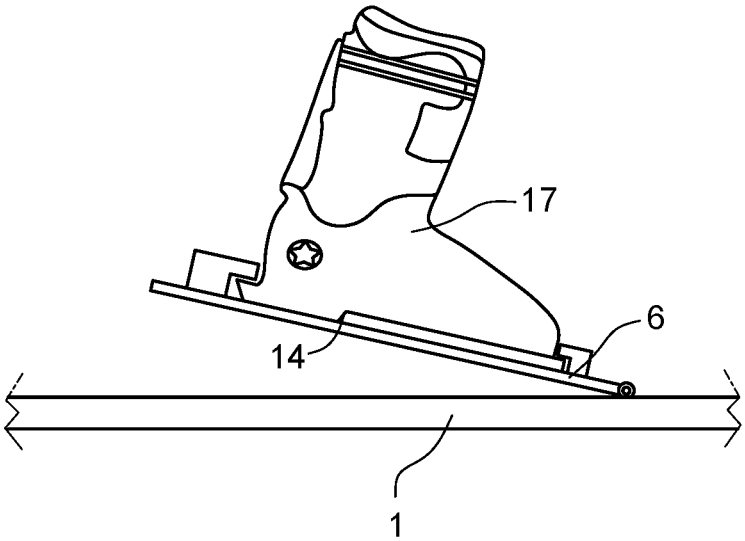
FIGS. 12 and 13 illustrate the shoe according to the invention. The term "ski" used in the examples includes all kinds of skis, and splitboards, rollers skis or snowshoes.
Figure 13:
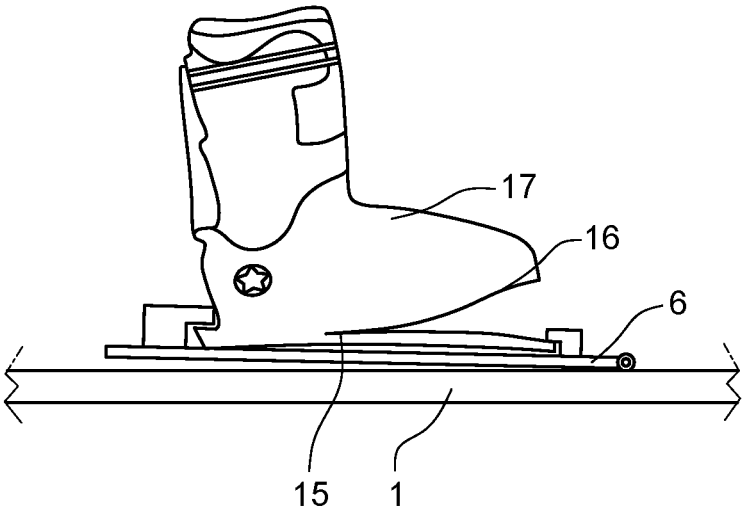

Toa ski 1 a plate 2 is mounted 2 (FIG. 9). The plate 2 is elastic. To the plate 2 a shoe clamp 3 is mounted. The plate 2 is connected with the ski 1 by stiff bonding 4. Between the plate 2 and the ski 1 there is an elastic plate 5. The elastic plate 5 is connected with the ski by an articulated joint in its back part and by stiff bonding in its front part. The elastic plate 5 is bent upwards to create an arching. The plate pressed from the top straightens, and then comes back to the previous shape—when there is no pressure. To the plate 2 a standard ski binding 6 is fixed, in which the shoe toes clamp 3 permits lifting of the shoe heel. The binding 6 has a shoe heel clamp permitting to immobilize the heel during the slide.

Example 9

The binding comprises a stiff plate 7 fixed to the ski 1. To the stiff plate 7 from the top an elastic plate 8 is mounted in a way permitting to lift upwards the front part of the elastic plate 8. The stiff plate 7 in its front part is mounted on a hinge 9 to the ski 1 in a way, which permits to lift upwards the back part of the plate 7. The elastic plate 8 and the stiff plate 7 are connected by frame 10 by hinge bonding 11. The frame 10 is used for mounting the shoe and constitutes a scaffold connecting both plates and enabling movement of the toes and the heel upwards and downwards. At the bottom of the stiff plate 7, between the plate 7 and the ski 1 there is a support for the heel 12. The plate 7 may be immobilized by a clamp 13, in order to enable safe slide.

Example 10

A shoe for riding skis/splitboard/roller skis 17 is mounted to the ski 1 in a binding permitting to lift the heel 6. The sole of the shoe 14 consists of two layers connected with each other in the area of the heel. The bottom layer of the sole 15 is stiff, and it is intended for mounting in the bindings, while the upper layer of the sole 16 is elastic and permits to lift the toes upwards.

The invention claimed is:

1. A binding for skis and/or splitboard and/or roller skis and/or snowshoes permitting free lifting of a heel, characterized in that it permits to lift the front part of the foot, and it comprises a stiff plate (7) fixed to a ski/board/roller ski/snowshoe (1) in its front part, to the said stiff plate an upper elastic plate (8) is fixed in a way permitting to lift a front part of the elastic plate (8).

2. The binding according to claim 1 characterized in that the stiff plate (7) is mounted on a hinge (9).

3. The binding according to claim 1, characterized in that the elastic plate (8), and the stiff plate (7) are connected by a frame (10) by hinge bonding (11).

* * * * *